US005435599A

United States Patent [19]

Bernecker

[11] Patent Number: 5,435,599

[45] Date of Patent: Jul. 25, 1995

[54] RECORDING MEDIUM WITH COLORED PICTURE INFORMATION, IN PARTICULAR A CHECK CARD OR IDENTITY CARD

[75] Inventor: Otto Bernecker, Neufahrn, Germany

[73] Assignee: GAO Gesellschaft für Automation und Organisation mbH, Germany

[21] Appl. No.: 278,313

[22] Filed: Jul. 21, 1994

Related U.S. Application Data

[62] Division of Ser. No. 962,360, Oct. 16, 1992, Pat. No. 5,350,198.

[30] Foreign Application Priority Data

Oct. 18, 1991 [DE] Germany ..... 41 34 539.8

[51] Int. Cl.[6] ..... B42D 15/00

[52] U.S. Cl. ..... 283/70; 283/67; 283/77

[58] Field of Search ..... 283/67, 68, 69, 70, 283/77, 901, 902, 904, 109; 359/2

[56] References Cited

U.S. PATENT DOCUMENTS

| | | | |
|---|---|---|---|
| 4,523,777 | 6/1985 | Holbein et al. | 283/67 |
| 4,579,754 | 4/1986 | Maurer et al. | 428/29 |
| 4,596,409 | 6/1986 | Holbein et al. | 283/75 |
| 4,732,410 | 3/1988 | Holbein et al. | 283/67 |
| 4,773,677 | 9/1988 | Plasse | 283/70 X |
| 5,237,394 | 8/1993 | Eaton | 283/70 X |
| 5,350,198 | 9/1994 | Bernecker | 283/77 |
| 5,380,044 | 1/1995 | Aitkens et al. | 283/70 X |

*Primary Examiner*—Willmon Fridie
*Attorney, Agent, or Firm*—Bacon & Thomas

[57] ABSTRACT

A recording medium is provided with picture information in a tamper-resistant and high-resolution form. The picture information is broken down into a light/dark portion and a color portion. The light/dark portion needed for the visual impression is incorporated in the recording medium in a high-resolution form. The colored picture information is congruently superimposed on this portion so as to produce an integral ensemble. Protection from falsification is ensured by incorporating one of the portions of the picture information in the card structure in largely tamper-resistant fashion.

11 Claims, 2 Drawing Sheets

RECORDING MEDIUM WITH COLORED PICTURE INFORMATION, IN PARTICULAR A CHECK CARD OR IDENTITY CARD

This application is a division of application Ser. No. 07/962,360, filed Oct. 16, 1992 now U.S. Pat. No. 5,350,198.

BACKGROUND OF THE INVENTION

The present invention relates to a recording medium with colored picture information, in particular a check card or identity card, and to a method for producing such a recording medium.

At the current level of reproducing technology the colored representation of picture motifs is customary and generally expected. Advertising also operates chiefly with color contrasts. Recording media such as bank cards, telephone cards, credit cards, etc., cannot resist this modern trend either, i.e. they are chiefly provided with colored motifs, in particular when they serve as advertising vehicles as well as performing their primary function.

A number of possibilities are known for transferring color pictures to such recording media. Alongside traditional photographic methods, it has also proven useful recently to use so-called transfer methods whereby the colorants are transferred from thin color media onto or into the picture-carrying surface by thermodiffusion or thermosublimation. Color pictures can also be produced by ink-jet technology or thermal printers, to mention only a few possibilities.

The disadvantage shared by all these methods, however, is that the applied color pictures are insufficient from the point of view of antifalsification since they only adhere more or less firmly to the surface of a carrier material. This thin, superficial layer containing the colorants can be removed or altered either intentionally or unintentionally. In the case of identity cards, which are valid e.g. for two years or more, there is the danger of mechanical wear or fading due to environmental influences.

One possibility for transferring a color picture that is reasonable from the security viewpoint is to use migrating inks, as are known from German patent no. 27 50 984. The migration of inks is based on first printing special inks on a plastic layer and then activating them by heat to migrate into the volume of the plastic carrier. It has the advantage over other methods for producing color pictures that the inks exist beyond the surface area within the volume of the plastic layer and can thus not be easily removed. The penetration depth can be controlled at will by adding to the plastic a reactive crosslinkable component that can be activated at the desired penetration depth, e.g. by irradiation with UV light. The resulting crosslinking stops any further migration of the colorant.

This method requires a special coordination of the inks used with the plastic carrier used. If the penetration depth of the inks is high, which is desirable for security reasons, this impairs the resolution or sharpness of the picture information.

From the point of view of antifalsification at the same time as high resolution it has proven useful to use so-called laser pencils, whereby the information to be transferred is burned into the material of the recording medium by a focused laser beam. German patent no. 19 07 004 discloses an identity card with a card inlay made of paper and a transparent cover film whereby certain information is inscribed or burned directly into the card inlay by laser beam after the cover film has been laminated on.

German patent no. 31 51 407 discloses a multilayer identity card with a specially designed transparent cover film. Despite its transparency in the visible region of the spectrum the cover film is able to absorb the energy of the laser beam so that information can be inscribed directly into the cover film.

The advantage of using a laser pencil is primarily that the resulting markings do not exist superficially but arise in the depth of the recording material. The carrier material is thereby discolored from its surface down to its deeper layers. The discoloration take place by local burning or local sooting; it is irreversible. At the same time the focal spot of the laser can be limited by precise control so as to produce portraits with clear and even extremely fine details.

When laser pencils and customary card structures are used the picture information is generally rendered by black-and-white contrast or corresponding half-tones. It is normally impossible to produce colored motifs having equivalent security.

In the prior art one must thus distinguish between information that can be incorporated in a recording medium as a high-resolution black-and-white contrast and is largely resistant to falsification, and color pictures that are applied by conventional methods but can either be removed or altered without great effort or are sufficiently resistant to falsification but have a low resolution.

The invention is based on the problem of developing known recording media so that they can be provided with colored picture information that shows fine details, is virtually irreversible and can almost not be falsified. Despite this high resistance to falsification the recording medium should also be of simple construction and inexpensive to produce.

SUMMARY OF THE INVENTION

The crucial finding for the invention is to break the picture information down into two portions, a light-/dark portion and a colored portion. One of these portions, preferably the light/dark portion, is incorporated in tamper-resistant fashion in a largely transparent film layer. The partial picture thus produced is then overlaid congruently with the other portion, preferably the colored portion, of the same picture information. This results in a complex ensemble composed of the color value of the various superimposed picture portions and the backscatter force of the background. If the reversible part of the picture information is removed the part firmly anchored in the card structure remains, still permitting identification.

In a preferred embodiment the unfalsifiability is ensured by the permanent black-and-white representation incorporated by means of a laser; the color information printed or applied in some other way thereabove provides the desired esthetically appealing effect. The invention therefore makes it possible to use colored picture information in recording media such as check cards or identity cards whereby the color pictures cannot be falsified in their totality since part of the picture exists in an irreversible form within the volume of the recording medium material.

It proves to be particularly advantageous that the invention makes it possible to combine existing technologies individually unable to solve the problem of producing a color picture resistant to falsification and tampering, in such a way that one can exploit the advantages of these technologies without having to put up with their disadvantages. For example it is readily possible to combine sharp black-and-white information with more or less fuzzy color information without the resulting color picture appearing fuzzy. In a development of the invention this aspect can even be selectively utilized by not only applying the color information of the picture by techniques resulting in fuzzy contours (e.g. migrating inks) but already processing the color information in a relatively coarse resolution, i.e. with less data effort.

BRIEF DESCRIPTION OF THE DRAWINGS

In the following some embodiments of the invention shall be described by way of example with reference to the enclosed drawings, in which.

DETAILED DESCRIPTION OF THE PREFERRED EMBODIMENTS

Figure 1:
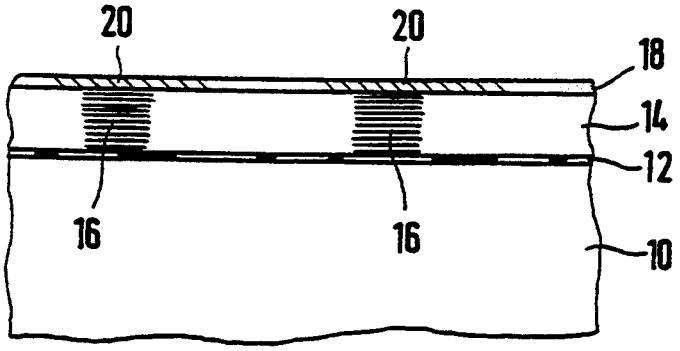
FIGS. 1 to 3 show cross sections through embodiment examples of the inventive recording medium.

The recording medium shown in FIG. 1 is a multilayer recording medium comprising a card inlay 10 that acts as a light-dispersing background. Inlay 10 can optionally be printed with a general printed pattern and a background pattern 12. With papers of value it is in particular customary to use hard-to-imitate guilloches as background patterns. The inlay bears a transparent film 14, for example a hard PVC film as described in German patent no. 31 51 407. This film is doped with additives so that it absorbs energy in a definite form in the wave range of the laser pencil but is largely transparent in the visible wave range.

Certain information is incorporated in the transparent film by means of a laser pencil in the form of more or less blackened areas. The blackened areas, marked 16 in the Figures, modulate the intensity of the fraction of incident light reflected by the light-dispersing background of inlay 10. The blacker the areas the lower the intensity of the reflected light fraction reaching the viewer.

Transparent film 14 can bear an ink-receiving layer 18 that has the corresponding colorants constituting the color portion of the picture information when the card is finished. The color information can also be printed directly on film 14 instead of being present on ink-receiving layer 18. Modern transfer techniques are preferably used for transferring the color picture. With such techniques the colorants are transferred from a thin color medium to the recording medium under the action of heat. The transfer mechanism is either a diffusion step or a sublimation step depending on the type of color medium or colorants used. It is recommendable to apply a special ink-receiving layer 18 when migrating inks are used.

An example of a transfer method is described in European patent application no. 0 390 928. A thermosublimation technique is used to transport colorants from a color medium to a recording medium. In the known case the heat necessary for sublimation is supplied with an accordingly shaped die. However it is also possible to supply the necessary energy with a laser beam.

For the viewer the black-and-white or gray-tone picture present in the film layer in form of blackenings 16 is overlaid with color picture 20 printed or applied onto the film layer to form an integral ensemble. If color picture 20 or ink layer 18 is removed gray-tone picture 16 still remains; a change in color picture 20 would be immediately visible to the viewer since the light/dark contrast belonging to the picture motif would be different or no longer fit the changed picture motif.

Figure 2:
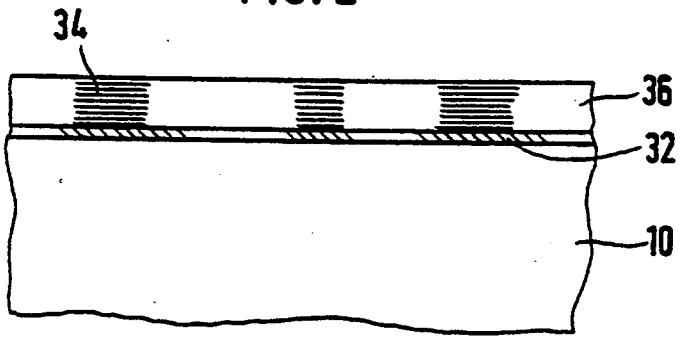

A further embodiment of the inventive recording medium is shown in FIG. 2. Inlay 10, which is made alternatively of paper or plastics, is provided with the color portions of picture information 32 by electrophotographic means. Suitable methods for electrophotographic incorporation of picture information in recording media are known e.g. from European patent no. 0 012 374 or European patent no. 0 024 344.

In this case as well, the inlay can of course be provided beforehand with a background pattern that is omitted from the figure for reasons of clarity. A thin transparent cover film 36 is then disposed over the colored fixed toner picture, the light/dark portion of picture information 34 being burned into cover film 36 by means of a laser pencil.

Figure 3:
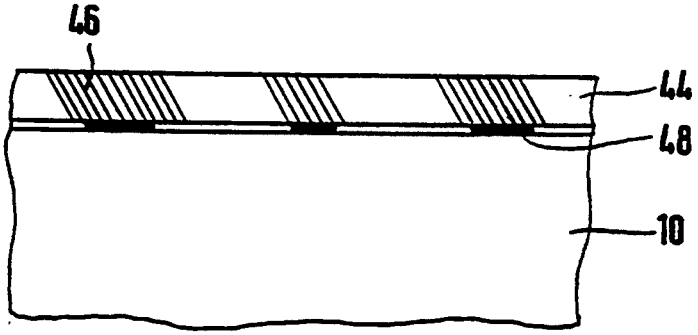

FIG. 3 shows a further variant of the inventive recording medium. In contrast to the recording medium shown in FIG. 1, the colored information portion in this case meets not only esthetic needs but also antifalsification requirements. The disadvantage of low resolution is encountered by applying the light/dark information decisive for the visual impression to the recording medium by a suitable method in this case as well, but in a more or less reversible form.

Inlay 10, that can again be printed with a background pattern, is provided with black-and-white information 48 using conventional methods, such as ink-jet screen printing or electrophotography, and covered in the following step with a substantially transparent plastic film 44 suitable for taking up migrating inks. Colored picture portions 46 are incorporated in the depth of the cover layer by means of migrating inks congruently with this light/dark information 48. The cover film can first be printed with the colored picture information by screen printing. Under the action of heat the color migrates into the interior of the cover layer until UV irradiation initiates crosslinking in the cover layer thereby stopping further migration. This and similar methods are known from German patent no. 27 50 984 already mentioned at the outset.

Alternatively, one can first incorporate the colored information in the cover layer and only then apply the light/dark information by conventional printing methods.

In all embodiment examples the colored information can also be "peculiarized" to produce special effects. For example, the colored picture information can comprise only one or two color separations, or a certain striking color separation can be shown in black and white instead of the light/dark information.

Figure 4:
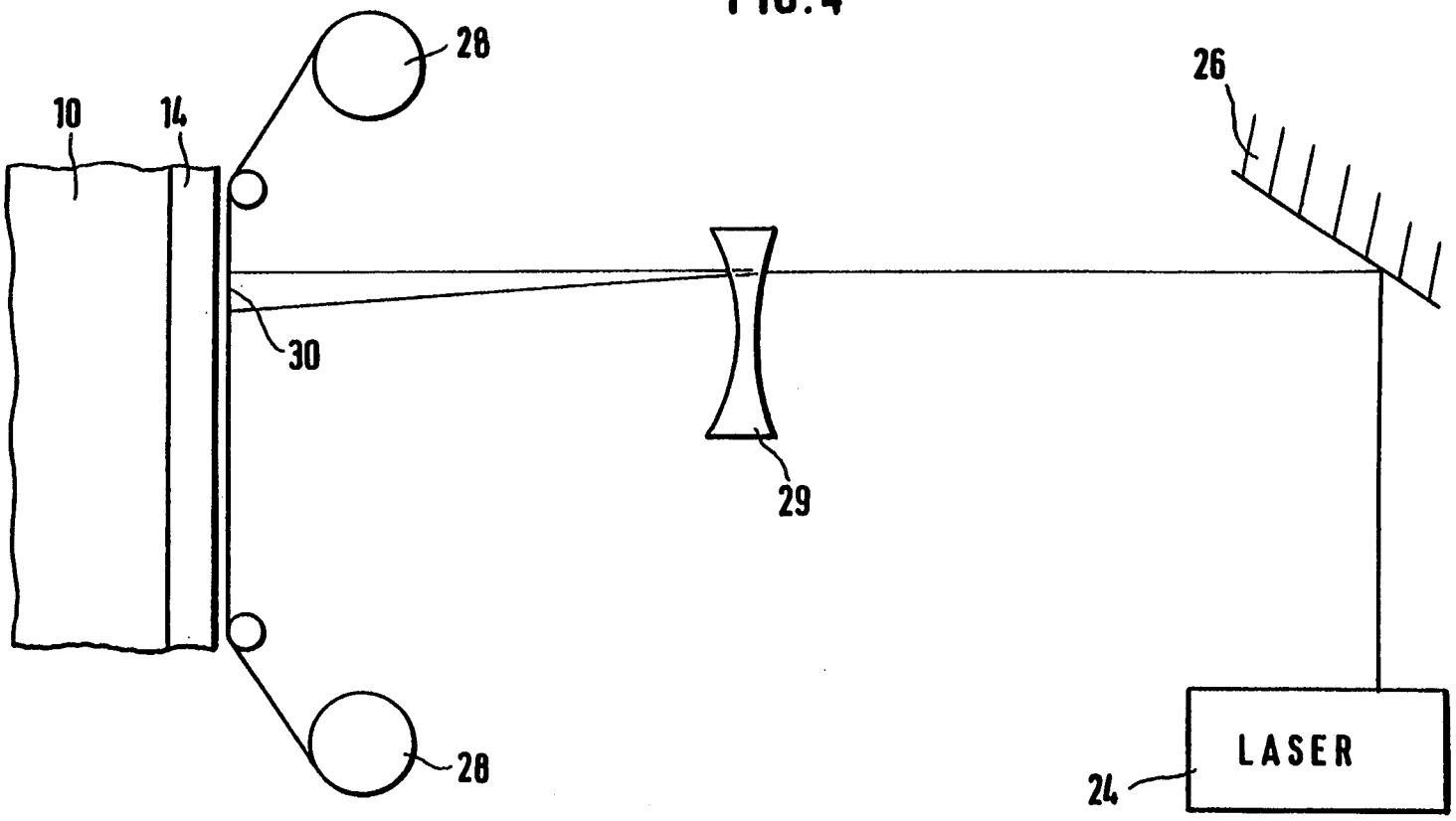
FIG. 4 shows a schematic representation of an apparatus for producing a recording medium.

FIG. 4 schematically shows an apparatus for producing a recording medium according to FIG. 1. The picture information is first broken down electronically into a light/dark portion and a colored portion. Such a procedure is known from modern printing technology and familiar to the expert.

The recording medium or transparent film layer 14 is first inscribed with the light/dark portion of the "information." This is done with a conventional laser pencil that is only suggested here. From a laser 24 a laser beam passes through a sweep means 26 and focusing optics not shown here to the surface of film layer 14. The material of the film layer absorbs the energy of the laser beam, thereby thermally decomposing or discoloring.

In a second method step the corresponding colored picture portion is printed congruently onto the gray-tone picture thus produced in the film layer. In the example shown a transfer method is used for this purpose. A thermodiffusion film is brought via supply reels 28 in the immediate vicinity of film layer 14. A beam-spreading optical system 28 is swung into the beam path and causes the laser beam to heat a surface 30 of the thermodiffusion band that is greater than the focus of the laser beam during inscription of the gray-tone picture in film layer 14. The thermal energy radiated into the diffusion film causes the colorants to diffuse into the recording medium or into an ink-receiving layer 18 provided on the recording medium.

The thermodiffusion film can have transparent windows at certain intervals for the laser radiation so that the position of the supply reels need not be changed throughout the recording process. In the first method step the light/dark portion is inscribed in film layer 14 through such a window. For the second method step a thermosensitive area of the band is then transported into the effective radius of the laser so that the color information can be transferred.

The different resolutions between the gray-tone picture and color picture permit certain esthetic effects to be obtained. One can of course also use the same resolution, for example when the colored picture portion is not applied by a transfer method but printed by a conventional method.

Regardless of whether both information portions are produced by the same "printing apparatus" as with the laser assembly shown in FIG. 4, or in completely separate method steps, it is always necessary to coordinate the data records in order to obtain the desired congruence. This congruence is obtained according to the invention for example with data records that have common x-y coordinates relating to the card edges. Alternatively, markings can of course be provided in the printed pattern of the card that are detected by optical sensors and used for coordination. Such markings can for example be the limitation of the field in which the picture is to be incorporated. However they can equally be any conventional printing marks integrated inconspicuously into the general printed pattern.

The apparatus described in FIG. 4 is merely an example; it has the special advantage that both production steps, i.e. inscription of the gray-tone picture and application of the colored picture information, can be performed using one and the same laser pencil. If a printing method were selected for applying the colored information portion the recording medium would have to be transferred to a suitable printing apparatus after incorporation of the gray-tone picture. With knowledge of the inventive principle, however such further embodiments are realizable for the average expert.

I claim:

1. A method of producing a multilayer recording medium including at least two layers, one which is inaccessible from the exterior of the medium, and combined picture information, comprising the steps of:

a) dividing said picture information into at least two information parts comprising a color picture and the other of which is a light/dark picture;

b) incorporating the light/dark picture in a sensitized transparent film layer by means of a controlled laser beam to form a gray-tone picture;

c) congruently superimposing the color picture on the light/dark picture information present in the transparent film layer as the gray-tone picture.

2. The method of claim 1, wherein step c) comprises the step of printing the color picture as an ink layer.

3. The method of claim 1, wherein step c) comprises the step of transferring the color picture as an ink layer by a transfer method.

4. The method of claim 3, further comprising the step of applying a special ink-receiving layer to the film layer for taking up colorants transferred by the transfer method.

5. The method of claim 4, wherein the step of transferring comprises the step of transferring colorants by a thermosublimation method.

6. The method of claim 4, wherein the step of transferring comprises the step of transferring colorants by a thermodiffusion method.

7. The method of claim 3, wherein the step of transferring comprises the step of supplying the thermal energy for the ink transfer by laser beam.

8. The method of claim 7, wherein step b) and the step of transferring are performed with a same laser pencil.

9. The method of claim 7, wherein the step of supplying the thermal energy comprises the step of focusing the laser beam less strongly for the ink transfer than for carrying out step b).

10. The method of producing a multilayer recording medium comprising at least two layers including one layer inaccessible from the exterior of the medium and combined picture information, comprising the steps of:

a) dividing said picture information into at least two information parts comprising a color picture and a light/dark picture;

b) applying the light/dark picture to an inner card layer to form a gray-tone picture;

c) covering the inner card layer provided with the light/dark picture with a substantially transparent film layer;

d) congruently superimposing the colored picture onto the picture information present under the transparent film layer as a gray-tone picture, by incorporating the color picture into the transparent film layer by means of migrating inks.

11. The method of claim 10, wherein step b) comprises the step of printing the gray-tone picture on the inner card layer.

* * * * *